United States Patent [19]

Dabrowski

[11] 4,345,787

[45] Aug. 24, 1982

[54] LOCK GUARD

[76] Inventor: Zdzislaw T. Dabrowski, 3301 Davison Ave., Erie, Pa. 16504

[21] Appl. No.: 157,899

[22] Filed: Jun. 9, 1980

[51] Int. Cl.[3] ..... E05C 21/00

[52] U.S. Cl. ..... 292/346

[58] Field of Search ..... 292/340, 346, 337, DIG. 51

[56] References Cited

U.S. PATENT DOCUMENTS

| | | | |
|---|---|---|---|
| 1,091,453 | 3/1914 | Fletcher | 292/346 X |
| 1,092,946 | 4/1914 | Page | 292/346 |
| 1,719,282 | 7/1929 | Wilson | 292/DIG. 51 |
| 2,446,206 | 8/1948 | Beckman | 292/341.12 |
| 2,645,516 | 7/1953 | Robertson | 292/341.12 |
| 3,825,291 | 7/1974 | Sprunger | 292/346 |
| 3,934,910 | 1/1976 | Radke | 292/346 |
| 3,967,845 | 7/1976 | Govervale | 292/346 |
| 4,178,027 | 12/1979 | Charron | 292/346 |
| 4,183,586 | 1/1980 | Ferracane | 292/341.18 |

*Primary Examiner*—Richard E. Moore

*Attorney, Agent, or Firm*—Wayne L. Lovercheck; Charles L. Lovercheck

[57] ABSTRACT

A guarded striker plate and guarded latch face plate set which provides for the use of the identical piece on either the door jamb or on the door. One embodiment uses an L-shaped configuration incorporating a one guard member. A second embodiment uses a Z-shaped member incorporating a two guarded member. Both the L and the Z configuration may also be employed singly or in pairs. In a final embodiment a Z configuration may be used on the door jamb and an L configuration can be used employed on the door providing for maximum security from unauthorized entry.

1 Claim, 7 Drawing Figures

FIG 2
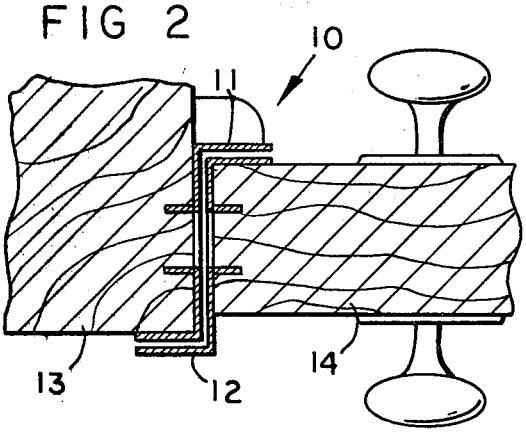
FIG 1
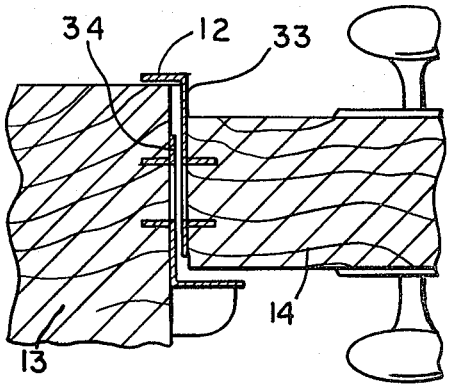
FIG 3
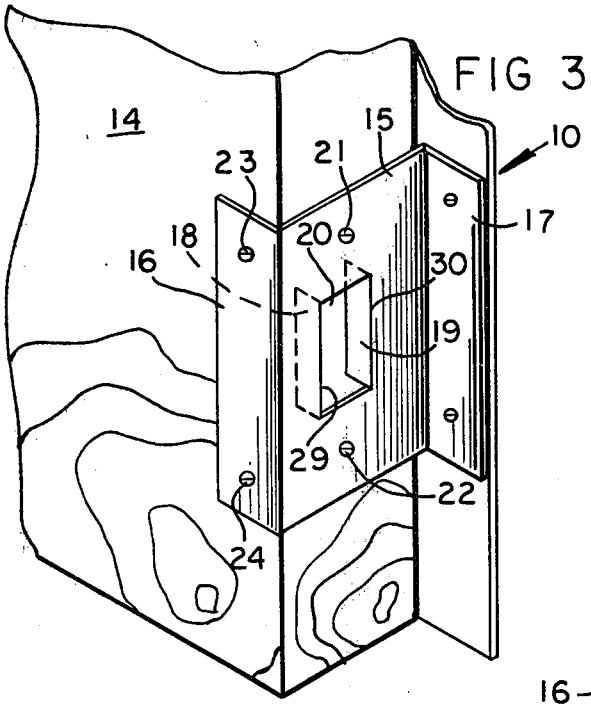
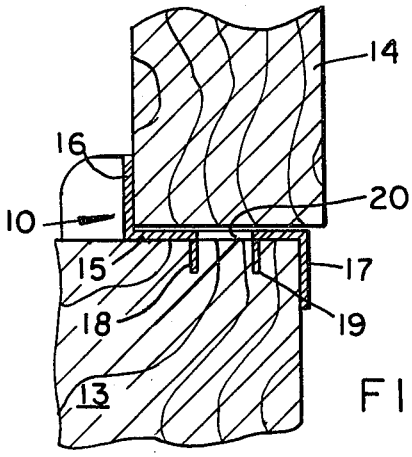
FIG 4
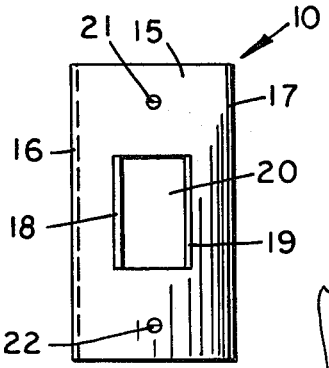
FIG 5
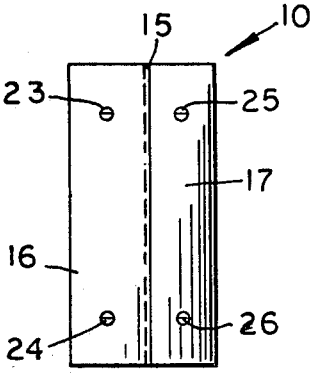
FIG 6
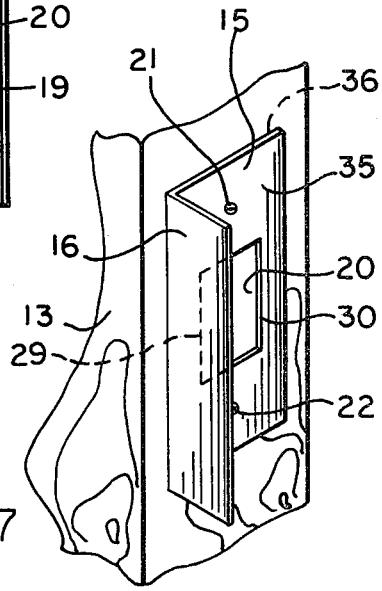
FIG 7

LOCK GUARD

BACKGROUND OF THE INVENTION

1. Field of the Invention

The present invention relates to the latches for doors, windows, hatches and other closure members and more particularly to a latch guard for preventing unauthorized releasing of such latches.

2. Description of the Prior Art

Guarded striker plates and guarded latch face plates such as those found in U.S. Pat. Nos. 1,092,946; 3,405,962 and 3,290,081 are well known in the art. No prior art is known to applicant which incorporates the use of the identical piece for both the guarded striker plate and the guarded latch face plate. It further provides a secure door guarding means which is economical to manufacture and simple and efficient to use.

SUMMARY OF THE INVENTION

The present invention provides a simple and effective door lock guard set which provides identical pieces for a guarded striker plate and guarded latch face plate.

It is an object of this invention to provide a door guard for preventing unauthorized entry through latched doors.

It is an object of this invention to provide guard means for both inwardly and outwardly opening doors which will prevent shifting the latch by the insertion of objects through the normal opening between the jamb and the door.

Another object of the invention is to provide a pryproof door guard that can be used interchangeably on the door or the door jamb or both.

Another object of the invention is to provide a pryproof door striker plate which is simple in design, economical to manufacture, rugged in construction and easy to use and efficient in operation.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWINGS

FIG. 1 is a top view of two L-shaped members according to the invention and mounted typically partly in cross-section.

FIG. 2 is a top view of two Z-shaped members according to the invention and mounted typically partly in cross-section.

FIG. 3 is a perspective view of a single Z-shaped member shown attached to a door jamb according to the invention.

FIG. 4 is an end view of a single Z-shaped member shown in cross section mounted on a door according to the invention.

FIG. 5 is a front view of a Z-shaped member according to the invention.

FIG. 6 is a side view of a Z-shaped member according to the invention.

FIG. 7 is a perspective view of a single L-shaped member shown attached to a door jamb according to the invention.

DETAILED DESCRIPTION OF THE PREFERRED EMBODIMENTS

A lock guard shown generally at 10 which comprises a guarded strike plate 11 or 11' which can be used in conjunction with a guarded latch face plate 12 or 12'. The guarded strike plate and guarded latch face plate are identical in configuration and are interchangeable in use. The guarded strike plate and guarded latch face plate each comprise an intermediate web 15 which is generally rectangular in shape and can have holes 21 and 22 adapted to receive screws to attach the plate to either the door or the door jamb. A first flange 16 is attached to the intermediate web 15 along a first end 27 of the intermediate web 15. First flange 16 extends from the intermediate web at an angle so that it will lie along the side of either the jamb or door and is generally rectangular in shape and has holes 23 and 24 adapted to receive screws to secure the plate to the door or jamb.

For added security, an L-shaped lock guard can be used on both the door jamb and the door for an inwardly or outwardly opening door. A first L-shaped lock guard 33 can be attached to the door. A second L-shaped lock guard 34, identical in configuration to the first lock guard is attached to the door jamb in a position adjacent to the first lock guard attached to the door and rotated about its vertical axis 180°.

In a preferred embodiment of the invention, a second flange 17 is attached to the intermediate web 15 along a second end 28 of the intermediate web 15. A second flange 17 is generally rectangular in shape and extends outwardly from the intermediate web at an angle and when the plate is attached to the jamb the second flange 17 adapted to engage the door and when the intermediate web 15 is attached to the door the second flange 17 is adapted to engage the door jamb. Thus, the second flange 17 when attached to either the door or the jamb extends outwardly therefrom and acts as a stop to the door when it is closed. In a closed position the Z-shaped lock guard is used on an inwardly opening door by attaching it to the door jamb. The Z-shaped lock guard is used on an outwardly opening door by attaching the lock guard to the door.

For added security, a Z-shaped lock guard can be used on both the door jamb and the door for an inwardly or outwardly opening door. A first Z-shaped lock guard 31 can be attached to the door. A second Z-shaped lock guard 32, identical in configuration to the first lock guard is attached to the door jamb in a position adjacent to the first lock guard attached to the door and rotated about its vertical axis 180°.

The intermediate web 15 has an aperture 20 to permit the passage of the lock hole. The aperture 20 is located approximately in the middle of the rectangular surface of the intermediate web.

A first tab 18 may be attached to the intermediate web 15 along a first side of the aperture 20. The first tab 18 extends away from the intermediate web 15 at an angle generally parallel to the first flange 16. A second tab 19 may be attached to the intermediate web 15 along a second side of the aperture 20. The second tab 19 extends away from the intermediate web 15 at an angle generally parallel to and spaced from said first tab 18.

The first tab 18 and second tab 19 form a guard adjacent the path of the lock bolt. The tabs will prevent access to the lock bolt by any device inserted into the space between the door and door jamb over or under the first flange 16 or the second flange 17.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A lock guard for use with locks of the type having a strike plate attached to a door jamb and a latchbolt plate attached to a door, the lock guard comprising, a first guard plate, the first guard plate comprising an intermediate web (15) having a first edge (27), a second edge (28), a front surface (35), and a rear surface (15), a first flange (16) attached to the intermediate web (15) at the first edge (27) thereof, the said first flange (16) being disposed at a right angle to said intermediate web (15) and extending outwardly from the front and adapted to rest on a door jamb surface thereof, a second flange (17) attached at a second edge (28) of the intermediate web (15) and adapted to overlie a doorstop, said second flange (17) being disposed at a right angle to said intermediate flange (15) and extending rearwardly from the rear surface thereof, an aperture (20) in said intermediate web (15) being disposed at approximately the midpoint thereof, an aperture in said intermediate web (15), the aperture having a first side and a second side, said aperture being adapted to receive the latchbolt of the doorlock, a first tab (18) attached to the intermediate web (15) adjacent a first side of said aperture (20) and a second tab (19) attached to the intermediate web (15) adjacent a second side of said aperture (20), said first tab and said second tab extending from said web in planes generally parallel to said first flange at said first side and said second side of said aperture (20), respectively, a second guard plate, said guard plate being identical in configuration to said first guard plate and comprising an intermediate web (15) having a first end (27), a second end (28), a front surface (35), and a rear surface (26), a first flange (16) attached to the intermediate web (15) at the first end (27) thereof, said first flange (16) being disposed at a right angle to said intermediate web (15) and extending outwardly from the front surface thereof, a second flange (17) attached at a second end (28) of the intermediate web (15), said second flange (17) being disposed at a right angle to said intermediate flange (15) and extending rearwardly from the rear surface thereof, an aperture (20) in said intermediate web (15) being disposed at approximately the midpoint thereof, the aperture having a first side and a second side, said aperture adapted to permit the latch bolt of the doorlock to pass therethrough a first tab (18) attached to the intermediate web (15) adjacent a first side of said aperture (20) and a second tab (19) attached to the intermediate web (15) adjacent a second side of said aperture (20), said first tab and said second tab being generally co-extensive with said first side and said second side of said aperture (20), said first tab and said second tab extend generally perpendicular to said intermediate web (15).

* * * * *